US006445275B2

(12) United States Patent
Yu

(10) Patent No.: US 6,445,275 B2
(45) Date of Patent: Sep. 3, 2002

(54) OVERLOAD-PROTECTION PUSH-BUTTON SWITCH WITH AUTOMATIC RESETTING MECHANISM OF PULL-PUSH TYPE

(76) Inventor: Tsung-Mou Yu, No. 4, Alley 2, Lane 23, Sec. 3, Pa-Te Road, Pan-Chiao, Taipei Hsien (TW)

( * ) Notice: Subject to any disclaimer, the term of this patent is extended or adjusted under 35 U.S.C. 154(b) by 91 days.

(21) Appl. No.: 09/751,905

(22) Filed: Dec. 28, 2000

(30) Foreign Application Priority Data

Dec. 30, 1999 (TW) ..... 88222437 U

(51) Int. Cl.[7] ..... H01H 71/00; H01H 71/16

(52) U.S. Cl. ..... 337/68; 337/52; 337/66; 337/380; 337/414; 200/283

(58) Field of Search ..... 337/52, 66, 68, 337/70, 75, 85, 112, 298, 333, 343, 414, 380; 200/400, 283, 237

(56) References Cited

U.S. PATENT DOCUMENTS 4,661,667 A 4/1987 Sorimachi et al.
4,704,594 A 11/1987 Krasser
4,931,762 A 6/1990 Fierro
4,937,548 A 6/1990 Sdunek
5,223,813 A 6/1993 Cambreleng et al.
5,451,729 A 9/1995 Onderka et al.
5,786,742 A 7/1998 Yin

*Primary Examiner*—Jayprakash N. Gandhi

(57) ABSTRACT

An overload-protection push-button switch with automatic resetting mechanism of pull-push type is disclosed. The switch is characterized in that a pull-push rod and a floating rocker are used to transmit a force on a pressing stem to a conducting leaf. Moreover, a guiding mechanism including a guider and a guided-member on the floating rocker is used to guide the moving direction of the floating rocker under the action of the pull-push rod. Thus, the direction force on the pressing stem can be different from the moving direction of the nose of the floating rocker by which the conducting leaf is actuated. Moreover, in case of overload, a positioning unit for positioning the pressing stem will be unlocked and thus the pressing stem can automatically return to its reset position. In view of the above, a push-button switch that has simple and easily-assembled structure as well as an operation of exactly tripping is available.

8 Claims, 13 Drawing Sheets

OVERLOAD-PROTECTION PUSH-BUTTON SWITCH WITH AUTOMATIC RESETTING MECHANISM OF PULL-PUSH TYPE

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a push-button switch and, in particular, to an overload-protection push-button switch with a simple structure capable of actually tripping and automatically going to a reset position in case of overload, in which the moving direction of a push-button is vertical to the moving direction of a conducting leaf.

2. Description of the Related Art

There are many types of push-button switches for various applications, such as one having a turn-on indicating lamp and one providing an overload protection function. In terms of one having an overload protection function, there are also several kinds of protection principles or mechanisms being adopted. For example, both the blow-out of a fuse wire and the thermal deformation of a bimetal blade have ever been adopted as a trigger source for an overload protection. However, the fuse wire is not repetitive and thus its utility rate gradually decreases. As for the thermal bimetal blade, there are many kinds of mechanism, such as those disclosed in U.S. Pat. Nos. 5,786,742, 5,223,813, 4,937,548, 4,661,667, 4,931,762, 5,451,729, and 4,704,594.

For example, in the U.S. Patent No. 5,786,742, a so-called power-cutting member (72) used to alternatively set a set and a reset position of a switch is disclosed. In that case, a bimetallic blade (75) is used to push a shaft seat (71) to trip and automatically reset a switch. However, the contacts in such a switch are directly depressed by a button. Thus, if the button has jammed or pushed down by an external force, they would be kept in its conducting position even if overload occurs. Moreover, such a switch is not economical because of a use of up to four contacts to construct a conducting circuit. It also increases the possibility of generating an arc. Furthermore, it is troublesome in assembly due to a need for connecting a wire between the bimetallic blade (75) and the conducting plate (74).

In U.S. Pat. No. 5,223,813, a bimetallic blade (13), a common trip (17) actuated by the bimetallic blade and a cam member (27) are incorporated with a rocker actuator (33) to make contact members (7,1) contact to or separate from each other. In such a patent, the common trip (17) will be displaced in response to a deformation of the bimetallic blade so that the cam member (27) is released and the switch trips. However, even though the common trip is indirectly actuated by a rocker actuator so that a jamming of the rocker actuator or a contact of the contact members by a neglectful re-push after overload can be avoided, such a switch is rather complicated. Moreover, since it needs a wire to connect its cantilever spring (5) and its bimetallic blade (13), its assembly is also troublesome. Furthermore, a fail-action is possible in case of overload since the bimetallic blade may be unable to simultaneously actuate both of the rocker actuator (33) and the common trip (17).

In a circuit breaker disclosed in U.S. Pat. No. 4,937,548, a thermal actuator (76) is used to displace a lock lever (62) upon deformation so as to release a bell crank lever operator (52). In this case, even a jamming of the actuator and a connection between the contacts upon a neglectful re-push on the switch after overload can be avoided, such an arrangement has not an automatic resetting function and is difficult to install an indicator therein, Moreover, since two thermal actuators are forced against one biasing spring, a tilt of the two thermal actuators may happen.

In U.S. Pat. No. 4,661,667, a double-heart-shaped cam locking mechanism is used to obtain two locking-positions. However, such a switch has not an overload protection function and a status-indicating function.

BRIEF SUMMARY OF THE INVENTION

A main object of the present invention is to provide an overload-protection push-button switch with an automatic resetting mechanism of pull-push type, which has a simple structure and a low manufacturing cost and is easy to assemble.

Another object of this invention is to provide an overload-protection push-button switch with an automatic resetting mechanism of pull-push type, in which the moving direction of the bush button is vertical to the moving direction of the conducting leaf and a trip function can be exactly performed in case of overload.

To achieve the above objects of this invention, this invention provides an overload-protection push-button switch with an automatic resetting mechanism of pull-push type comprising:

a housing;

a switching circuit installed in the housing, the switching circuit including: a first terminal, a second terminal, a first conducting leaf and a bimetallic blade, the bimetallic blade having a movable closed end which is able to move from a normal position to an overload position, and an open end formed with a first and a second legs which connect the first terminal and the first conducting leaf, respectively; the first conducting leaf being movable between a conduction position at which the second leg of the bimetallic blade is electrically connected to the second terminal and a broken position at which the second leg is disconnected from the, second terminal; and an actuating unit installed in the housing, the actuating unit including:

a pressing stem received in the housing adapted to slide between a set and a reset positions;

a pull-push rod having two ends;

an enabling supporter being alternatively located in a supporting position and a tripping position in response to an allocation of the is bimetallic blade in its normal position and its overload position, respectively;

a floating rocker being formed with a nose for abutting against the first conducting leaf, a toe portion to be supported by the enabling supporter, a rod-engaging hole located between the nose and the toe portion to receive one end of the pull-push rod, a guided member for guiding a floating range produced by the rocker which is restricted by the pull-push rod, and a heart-shaped stepping recess located where the toe portion is;

a guider provided on the housing to match the guided member so as to limit the floating range of the rocker;

a cantilever having a fixed end fixed onto the pressing stem and a free end adapted to slide in the heart-shaped stepping recess;

whereby the toe portion of the rocker is enabled and disabled in response to the allocation of the enabling supporter in a supporting and a tripping position respectively in which when the toe portion is enabled the nose, presses and releases the conducting leaf to its conduction position and a broken position respectively in response to the allocation of the pressing stem in a set position and a reset position respectively under being driven by the pull-push rod and being limited by the guider; and when the toe portion is disabled the nose, the nose releases the conducting leaf to its broken position; and the heart-shaped stepping recess departs from the free end of the cantilever when the toe portion is disabled so as to release the pressing stem to return to its reset position; and subsequently the toe portion of the rocker is pulled to a standby position so as to be supported and enabled by the enabling supporter again when the bimetaic blade returns to its normal position.

By means of the above structure, since the conducting leaf is indirectly actuated by the push-button via the pull-push rod and the floating rocker, the switch will exactly and transiently trip at the time overload occurs even if the stem jams. Moreover, by means of the cooperation of the pull-push rod, the guided member and the guider, the direction to press the push-button can be changed to being vertical to the moving direction of the conducting leaf so as to meet some special applications. By means of the integration of the heart-shaped stepping recess with the toe portion in the floating rocker, the pressing stem will be unlocked from its set position by means of the rotating of the floating rocker and automatically return to its reset position when overload happens. In the meanwhile, the toe portion can also return to a standby position under the action of the pull-push rod so as to be supported and enabled by the enabling supporter.

BRIEF DESCRIPTION OF THE SEVERAL VIEWS OF THE DRAWINGS

In the following, preferred embodiments of the present invention will be described in detail in conjunction with the accompanying drawings, wherein.

DETAILED DESCRIPTION OF THE INVENTION

In the following, an overload-protection push-button switch with an automatic resetting mechanism of pull-push type according to a number of preferred embodiments of this invention will be described in reference to drawings.

Figure 1:
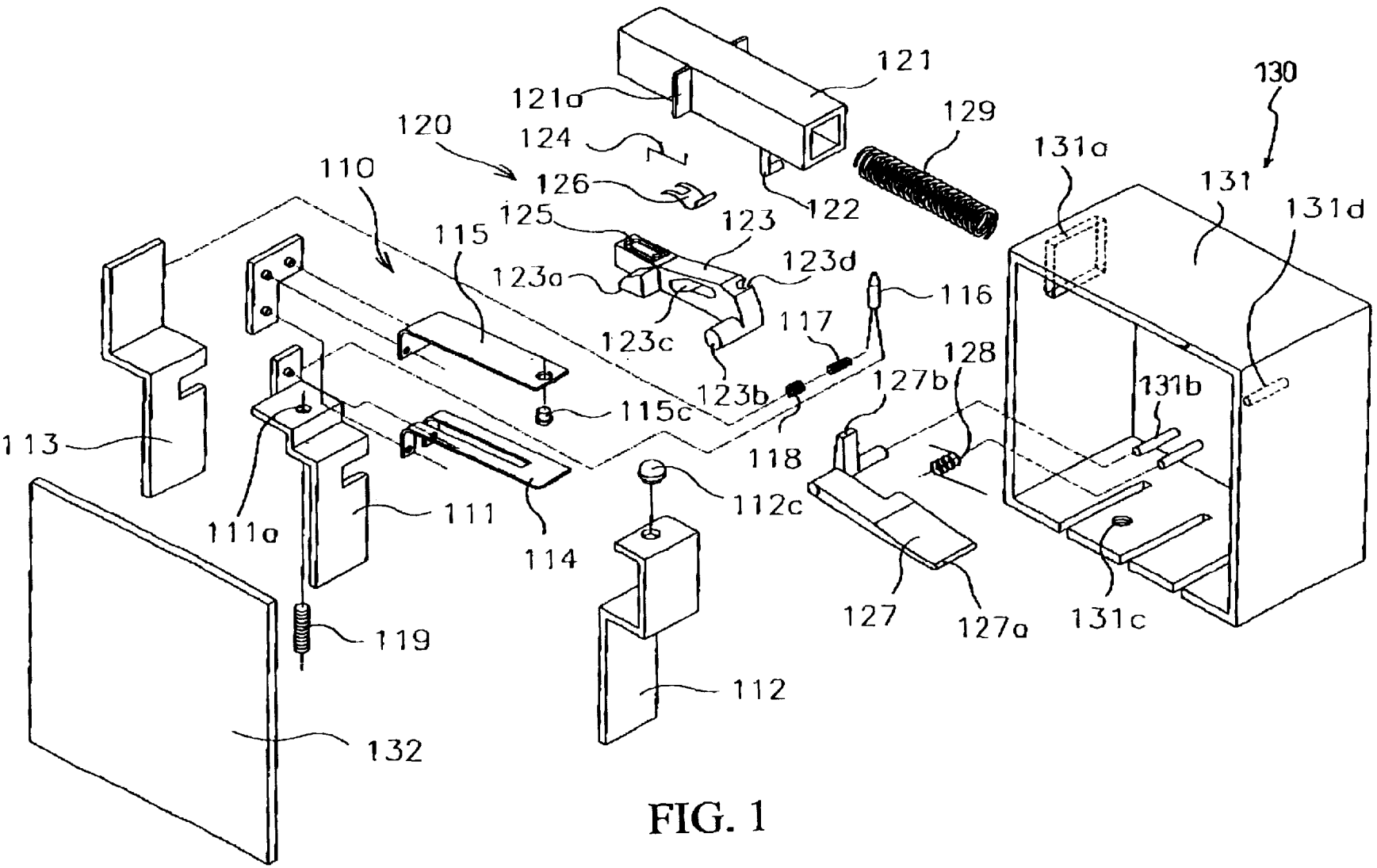
FIG. 1 is an exploded schematic perspective view of an overload-protection push-button switch with automatic reset mechanism of pull-push type in accordance with a first embodiment of this invention.

As shown in the exploded perspective view of FIG. 1, the overload-protection push-button switch with an automatic resetting mechanism of pull-push type in accordance with a first preferred embodiment of this invention generally comprises a switching circuit 110, an actuating unit 120 and a housing 130 receiving the switching circuit 110 and the acting unit 120. The housing 130 comprises a main shell 131 and a cover 132. The switching circuit 110 comprises a first terminal 111, a second terminal 112, a third terminal 113, a thermal-deformed bimetallic blade 114, a conducting leaf 115, an indicating lamp 116, a resistor 117 and a coil spring 118. The actuating unit 120 comprises a pressing stem 121, a pull-push rod 122, a floating rocker 123 a positioning unit mainly composed of a cantilever 124 and a heart-shaded stepping recess 125, a cantilever-biasing spring 126, a transmittal lever 127, a level-biasing spring 128, and a stem-biasing spring 129.

The main shell 131 is provided with a top wall, a bottom wall, a back wall and two sidewalls, and is formed with a key opening 131*a* on one of the sidewalls and a number of terminal holes (not indicated with numeral) on the bottom wall. Moreover, a lot of members for guiding or fixing the elements mentioned above are also formed integrally with the main shell 131. For example, a shaft 131*b* serving as a pivot of the transmittal lever 127 is formed. The details of these members could be contemplated by one skilled in the art along with the following disclosure and thus are omitted hereinafter for the sake of simplifying the description of embodiments.

As for the switching circuit 110, each terminal 111, 112, or 113 is held by respective tennis hole. The second terminal 112 is provided with a lower contact pad 112*c* inside the housing 110. The thermal-deformed bimetallic blade 114 is of a reversed-U shape having a closed end and an open end. The open end of the bimetallic blade 114 is constructed with two legs respectively being connected to the first terminal 111 and one end of the conducting leaf 115, as shown in FIG. 1.

Figure 2:
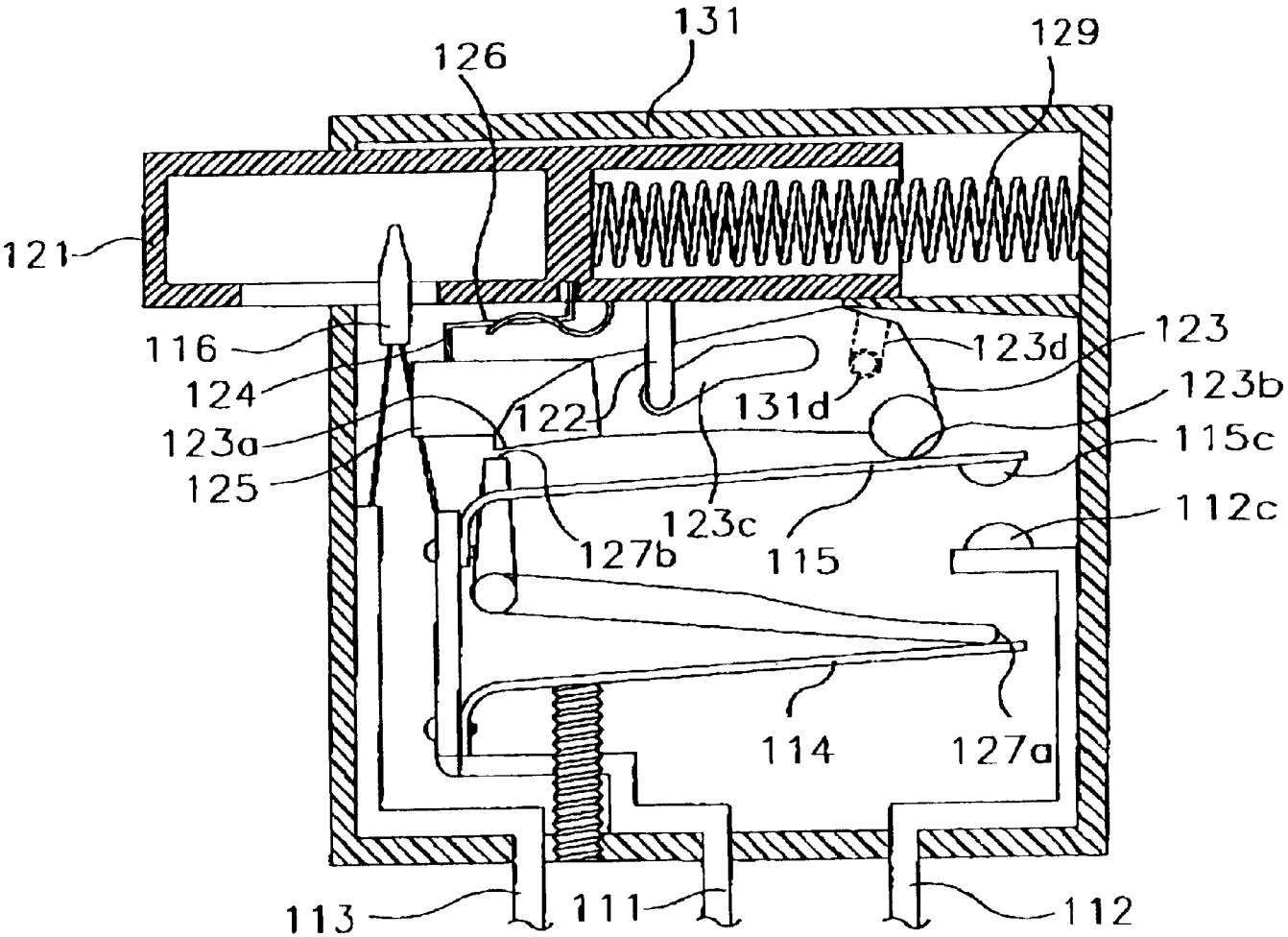
FIG. 2 is an assembled elevation view partly in section of the push-button switch of FIG. 1 in an OFF status.
Figure 4:
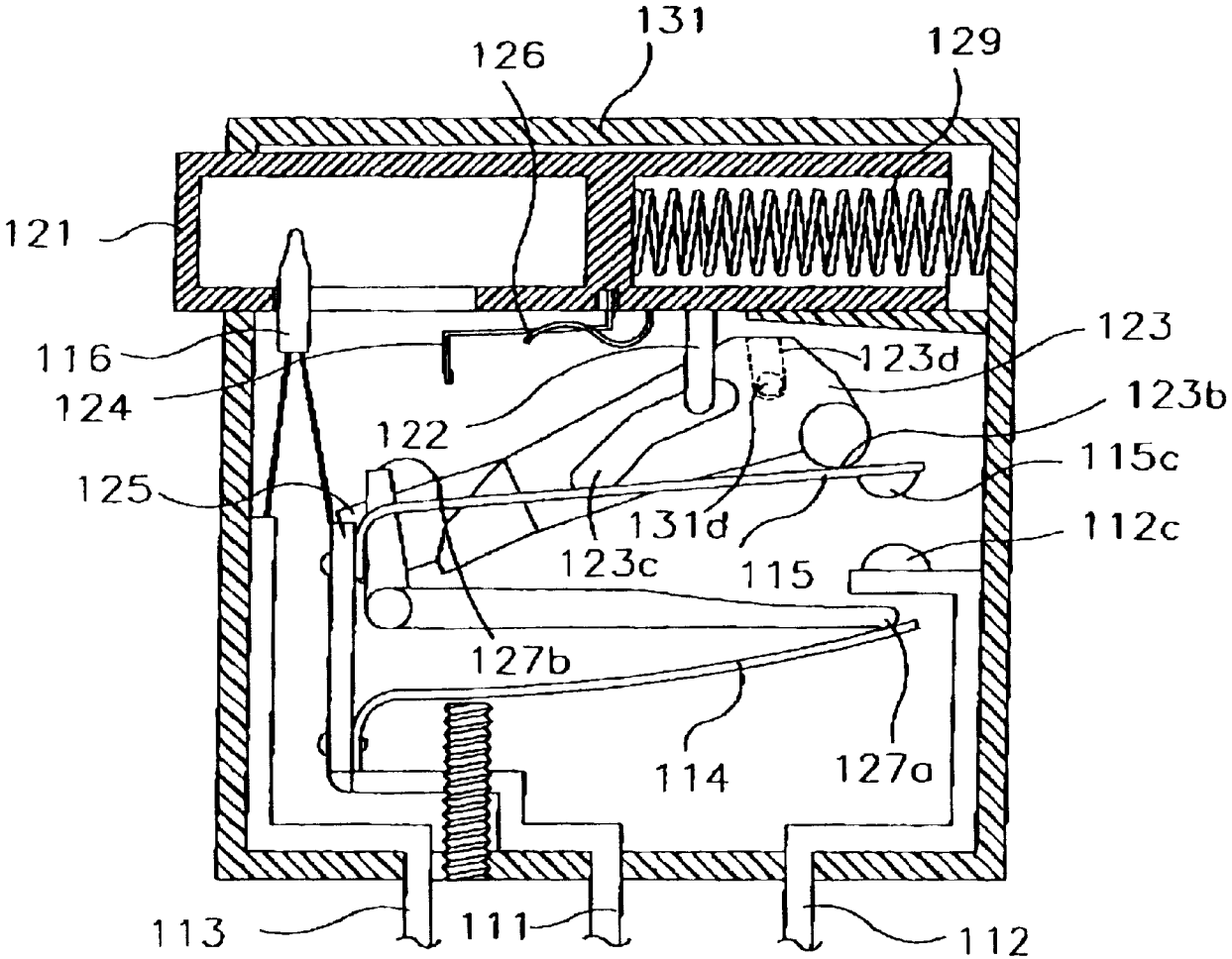
FIG. 4 is a view similar to FIG. 2 but in a trip status before the pressing stem returns to its reset position.

The thermal-deformed bimetallic blade 114 is in a normal position as shown in FIG. 2 if the current pass therethrough is not in overload, but in an overload position as shown in FIG. 4 if the current pass therethrough is in overload. Once overload disappears, the bimetallic blade 114 will automatically return to its normal position from its overload position.

The conducting leaf 115 is fixed and electrically connected to the bimetallic blade 114 at one end thereof, and is provided with an upper contact pad 115*c* at its free end so as to contact a lower contact pad 112*c* of the second terminal 112. Moreover, the indicating lamp 116 has two legs respectively connected to the first terminal 111 and the resistor 117. The resistor 117 is connected to the third terminal 113 via the coil spring 118.

Figure 3:
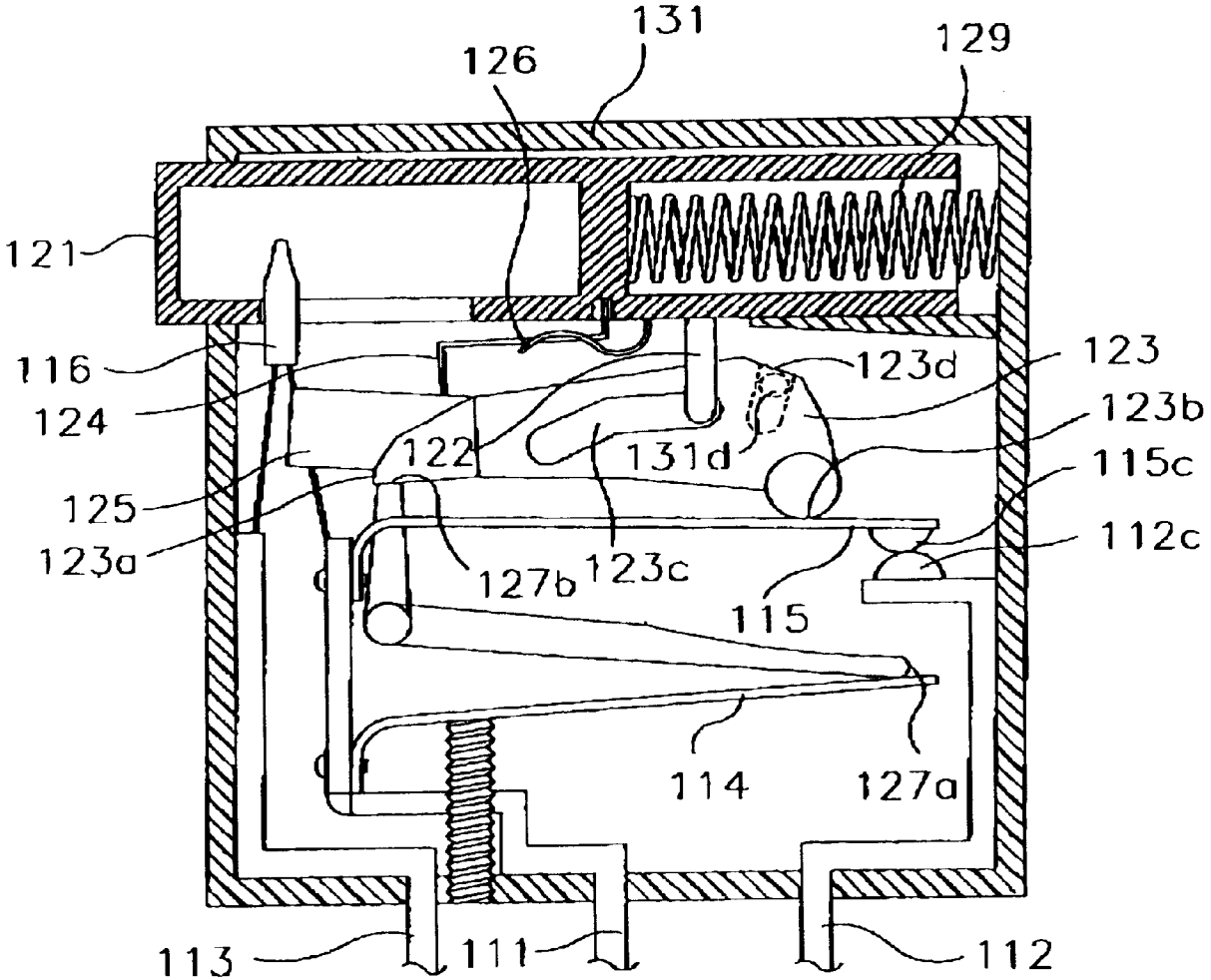
FIG. 3 is a view similar to FIG. 2 but in an ON status.

By means of the above, when the conducting leaf 115 is actuated by the actuating unit 120 and moves into a conduction position as shown in FIG. 3, an electrical contact is built between the upper and lower contact pads 115*c* and 112*c*. Thus, the power from the first terminal 111 will be transmitted to the second terminal 112 and to the third terminal 113 via the indicating lamp 116 so as to light up the indicating lamp 116.

As shown in FIGS. 1 and 2, the main shell 131 is formed with a bole 131*c* on the bottom wall in the neighborhood of the first terminal 111 for the pass of an adjusting screw 119. The first terminal 111 is provided with a screw hole 111*a* on the portion substantially parallel to the bimetallic blade 114. By means of engaging the adjusting screw 119 into the screw hole 111*a,* the inner end of the screw 119 could push against the bimetallic blade 114 so as to adjust the overload position of the bimetallic blade 114.

As for the actuating unit 120, as shown in FIGS. 1 and 2, the pressing stem 121 is of a square hollow shape in which a biasing spring 129 is received and thus the pressing stem 121 is biased leftward to a reset position as shown in FIG. 2 by the biasing spring 129. In the following, for the convenience of description, the moving direction of the pressing stem 121 is designated as a transverse direction, the up-down direction vertical to the transverse direction is designated as a vertical direction, and the direction vertical to the vertical and the transverse directions is designated as an axial direction, i.e., a direction form the front to the back of the housing. The pressing stern 121 is provided with two opposite fins 121*a* vertically extending from its front sidewall and back sidewall respectively. By means of the fins 121*a,* the reset position of the pressing stem 121 is decided.

The pull-push rod 122 is of an L-shape and has one end integrated with the pressing stem 121 and a leg end axially extending.

The floating rocker 123 is of a shape like a transversally-extending elongated block, and is formed with a toe portion 123*a* and a nose 123*b* at its two opposite end portions respectively, a rod-engaging elongated hole 123*c* located between the nose 123*b* and the toe portion 123*a,* a guiding slot 123*d* somewhat vertically extending for guiding the floating range of the floating rocker 123, and a heart-shaped stepping recess 125 which is located at the same side with the toe portion 123*a* and opens upward.

The toe portion 123*a* is designed as being supported and enabled by the transmittal lever 127 when it is mounted on the housing 110. The nose 123*b* is of a shape of a rod axially extending from a main body of the floating rocker 123 toward and above the conducting leaf 127, which can depress the conducting leaf 115 downward into a conduction position. The rod-engaging hole 123*c* is of a substantial arc shape for receiving and thus being actuated by the leg end of the pull-push rod 122. The rod-engaging hole 123*c* can be a through hole or a slot opening to one side surface. The guiding slot 123*d* receives a shaft 131*d* axially extending from the housing 110, which serves as a guider for the moving of the floating rocker 123. By means of the guiding slot 123*d* and the guider shaft 131*d,* the nose 123*b* will vertically move when the pull-push rod 122 rightward moves and thus actuates the floating rocker 123 moving.

The cantilever 124 is of a Z-shape constructed by a steel wire having proper flexibility and rigidity. The cantilever 124 has a fixed end fixed on the pressing stem 121 and a free end inserting into the heart-shaped stepping recess 125. The cantilever-biasing spring 126 is of a S-shape and used to force one end of the cantilever 124 staying in the pressing stem 121.

The detailed description of the heart-shaped stepping recess 125 is disclosed in the U.S. Pat. No. 5,786,742 and thus is omitted herein. The content of the U.S. Pat. No. 5,786,742 is incorporated herein for reference. The leg end of the cantilever 124 will move into a locking arch of the heard-shaped stepping recess 125 so that the pressing stem 121 is locked in a set position when the pressing stem 121 is pressed into the housing 131. However, if the pressing stem 121 is pushed again, the leg end of the cantilever 124 will escape the locking arch and thus the pressing stem 121 is released back to its reset position.

The transmittal lever 127 is of a L-shape serving as an enabling supporter. The transmittal level 127 is formed with an abutting surface 127*a* and a supporting portion 127*b* respectively located at two ends thereof, and is biased to a supporting position as shown in FIG. 2 by a level-biasing spring 128. In such a supporting position, the abutting surface 127*a* engages with the closed end of the bimetallic blade 114; the supporting position 127*b* stands up the toe portion 123*a* to react against the bias of the conducting leaf 115.

By means of the above construction, as shown in FIG. 2, when the bimetallic blade 114 is in a normal position, the transmittal level 127 is biased by the transmittal-biasing spring 128 into the supporting position in which the supporting portion 127*b* supports the toe portion 123*a* of the floating rocker 123 so as to enable the floating rocker 123. In such an enabling status, when the pressing stem 121 is not pushed and in a reset position, the pull-push rod 122 allocates at left side of the rod-engaging hole 123*c* and thus the nose 123*b* of the floating rocker 123 is not depressed down by the pull-push rod 122 so that the conducting leaf 115 is in a broken position due to itself elasticity. When the pressing stem 121 is pushed rightward into a set position and the leg end of the cantilever 124 falls into the locking arch of the heart-shaped stepping recess 125, the pull-push rod 122 moves into the right side of the rod-engaging hole 123*c* and forces the nose to move downward by virtue of the cooperation of the guiding slot 123*d* and the guider shaft 131*d* and the design of the higher allocation of the right side of the rod-engaging hole 123*c* than the left side thereof. Thus, the conducting leaf 115 will be actuated into a conduction position.

Alternatively, when the pressing stem 121 at the sit position is pushed again, the leg end of the cantilever 124 will be unlocked and the pressing stem 121 moves leftward by the biasing spring 129 into the reset position. In the meanwhile, the pull-push rod 122 moves into the left side of the rod-engaging hole 123*c* and releases the conducting leaf 115 into its broken position. Therefore, the nose 123*b* will alternatively make the conducing leaf 115 move into a conduction position as shown in FIG. 3 and a broken position as shown in FIG. 2 in response to the movement of the pressing stem 121 into its set position and its reset position respectively.

On the other hand, when the bimetallic blade 114 is deformed to an overload position as shown in FIG. 4 due to overload, the transmittal lever 127 will counterclockwise rotate, by virtue of the forcing of the closed end of the bimetallic blade 114 on the abutting surface 127*a,* into a trip position in which the supporting portion 127*b* departs from the toe portion 123*a* so that the toe portion 123*a* is disabled. In such a status, the nose 123*b* will move upward and release the conducting leaf 115 by virtue of a lever principle. The conducting leaf 115 then moves up due to its elasticity and into its broken position. The floating rocker 123 will counterclockwise rotate substantially around the pull-push rod 122. In the meanwhile, the first terminal 111 is cut from power source and the indicating lamp 116 is turned off.

In the status as shown in FIG. 4, the heart-shaped stepping recess 125 moves along the toe portion 127*b* and thus departs from the leg end of the cantilever 124. Subsequently, the pressing stein 121 is unlocked and thus moves from its set position to its reset position under the biasing of the biasing spring 129. In the meanwhile, the leg end of the pull-push rod 122 slides into the left side of the rod-engaging hole 123*c* and thus pulls the toe portion 123*a* and the heart-shaped stepping recess 125 upward. The toe portion 123*a* then returns to a standby position capable of being supported by the supporting portion 127*b* of the transmittal lever 127. Once the bimetallic blade 127 is in a normal position, the toe portion 123*a* is supported by the supporting portion 127*b* again and thus is enabled again. Thus, the switch according to this invention can automatically reset.

In the above trip course, owing to the floating rocker 123 being disabled, the switching circuit 110 can exactly break even if the pressing stem 121 fails to return to its reset position by a foreign force, Moreover, once the foreign force disappears, the pressing stem 121 can return back to its reset position as mentioned above and actuate the toe portion 123*a* into a standby position to be enabled.

Therefore, by means of the provision of the floating rocker, the provision of the cantilever and the heart-shaped stepping recess in the pressing stem and the floating rocker respectively, the cooperation of the guiding slot and the guider shaft, and the provision of the pull-push rod, as the switch could be actuated transversely, can automatically return to its is reset position in case of overload, and can exactly trip and the automatic reset. Besides, the one end of the cantilever can also be fixed on the floating rocker while the heart-shaped stepping recess is integrally formed with the pressing stem.

Figure 5:
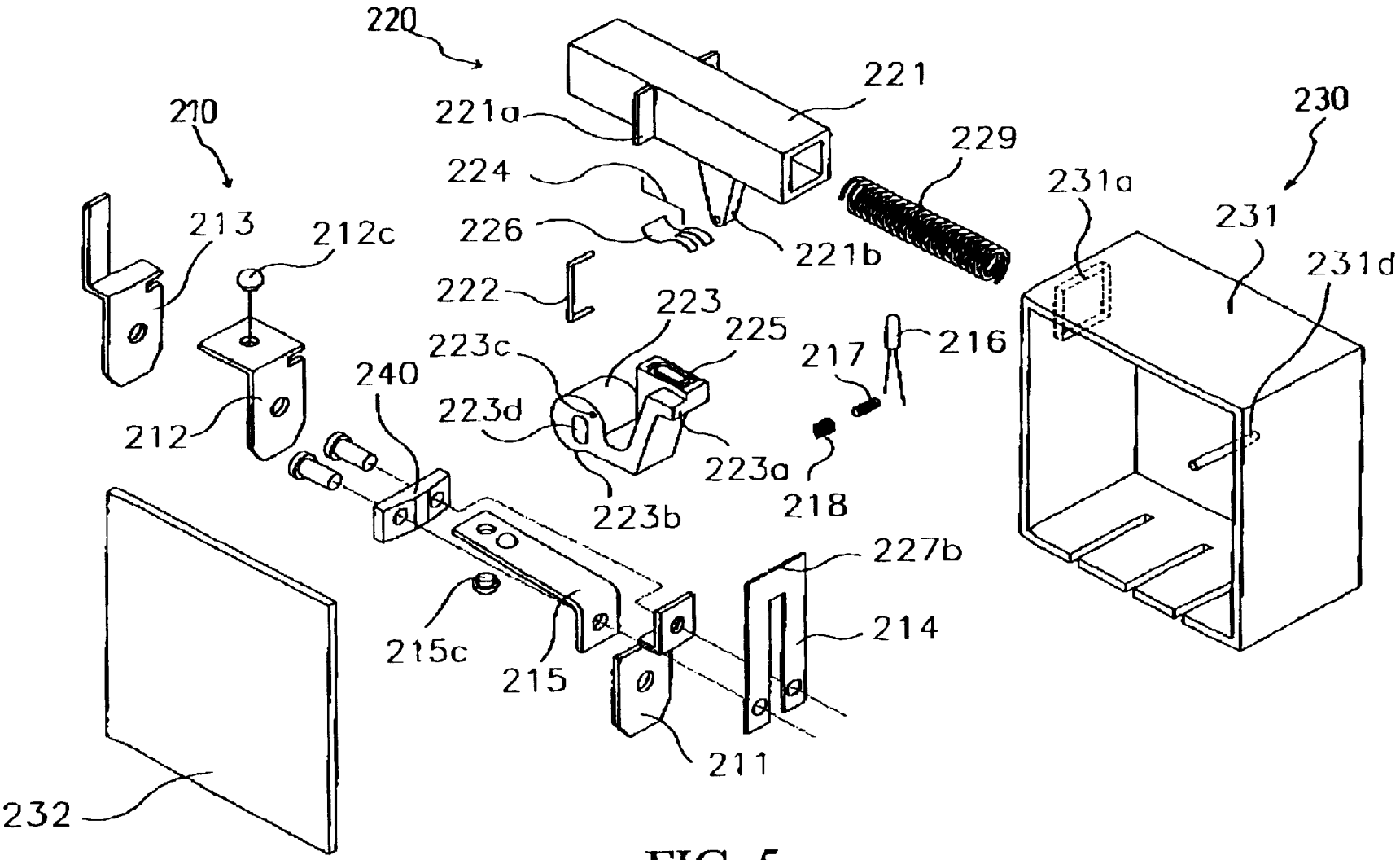
FIG. 5 is an exploded schematic perspective view of an overload-protection push-button switch with automatic reset mechanism of pull-push type in accordance with a second embodiment of this invention.

FIG. 5 shows an overload-protection push-button switch with an automatic resetting mechanism of pull-push type according to a second embodiment of this invention. The switch generally comprises a switching circuit 210, an actuating unit 220 and a housing 230. The housing 230 comprises a main shell 231 and a cover 232. The switching circuit 210 comprises a first terminal 211, a second terminal 212, a third terminal 213, a thermal-deformed bimetallic blade 214, a first conducting leaf 215, an indicating lamp 216, a resistor 217 and a coil spring 218. The actuating unit 220 comprises a pressing stern 221, a pull-push rod 222, a floating rocker 223, a positioning unit mainly composed of a cantilever 224 and a heart-shaped stepping recess 225, a cantilever-biasing spring 226 and a stem-biasing spring 129.

In comparison with the first embodiment the difference of them comprises the locations of the first and the second terminals, the shape of the bimetallic blade, the shape of the floating rocker, and the arrangement of the pull-push rod. The transmittal lever 127 in the first embodiment is omitted in this second embodiment and the edge of the closed end of the bimetallic blade is used to act as an enabling supporter 227*b* to dimly support the toe portion. The description of the elements corresponding to those in the first embodiment is omitted herein for the sake of simplification.

Figure 6:
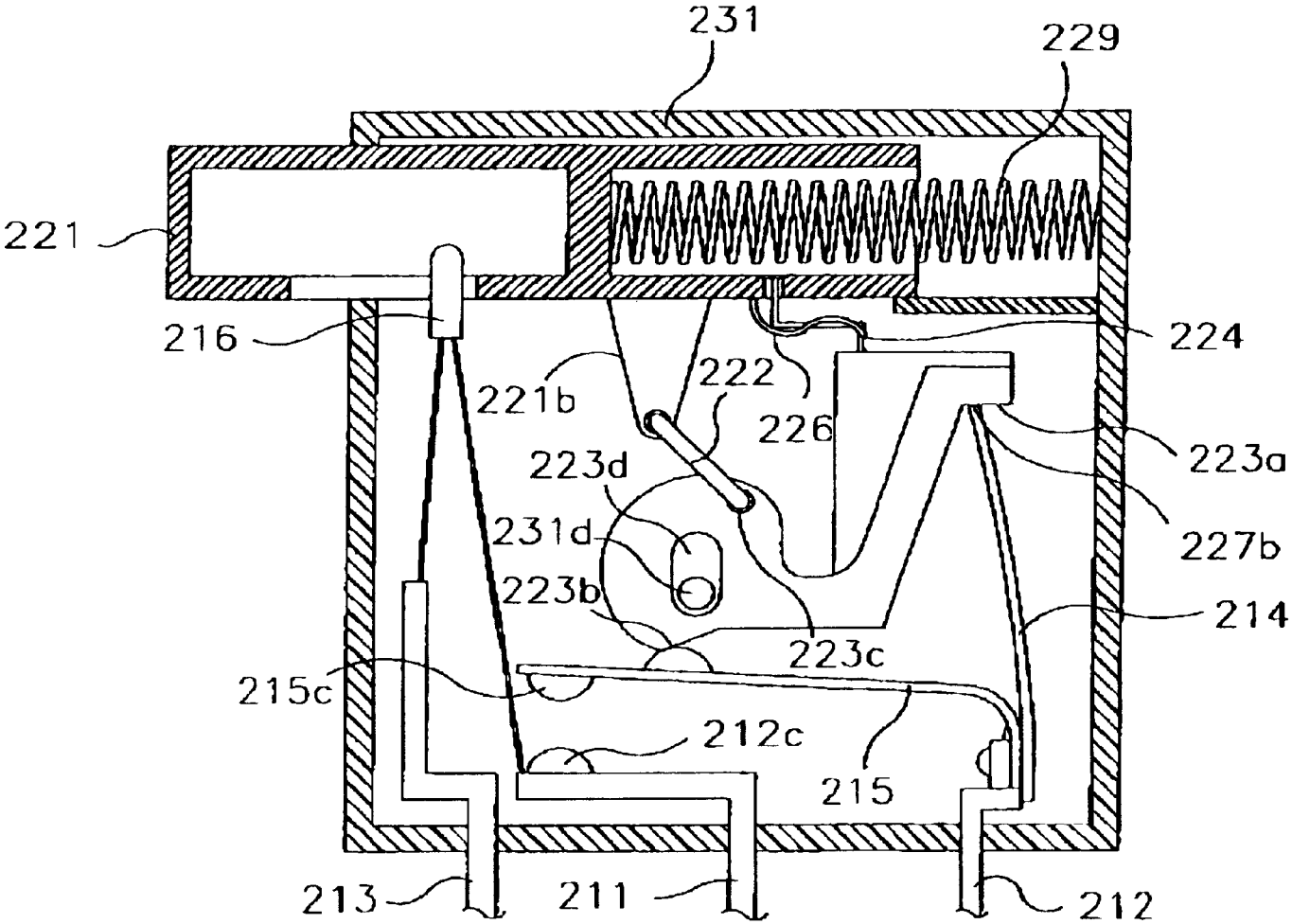
FIG. 6 is an assembled elevation view partly in section of the push-button switch of FIG. 5 in an OFF status.

In this embodiment, as shown in FIG. 6, the lower portion of the pressing stem 221 is provided with a seat 221*b* to carry one end of the pull-push rod 222. The floating rocker 223 is also provided with a toe portion 223*a,* a nose 223*b,* a rod-engaging hole 223*c,* a guided member 223*d* and a heart-shaped stepping recess 225 adjacent to the toe portion is 223*a*. However, the rod-engaging hole 223*c* in this embodiment is a round hole; the guided member 223*d* is an oval-shaped through hole; the nose 223*b* is formed by the edge of the floating rocker 223 itself; the toe portion 223*a* upward extending over the edge of the closed end of the bimetallic blade 214; the heart-shaped stepping recess 255 is at a height level at which the free end of the cantilever 224 can reach and insert into the recess. Moreover, the pull-push rod 222 is of a U-shape having two ends to respectively insert into a hole in the seat 221*b* and the rod-engaging hole 223*c* in the floating rocker 223. Furthermore, for enhancing the ability of the enabling supporter 227*b* at the closed end of the bimetallic blade 214 to depart from the toe portion 223*a* of the floating rocker 223 when overload happens, the two legs at the opening end of the bimetallic blade 214 arc fixed by a block 240 into a configuration that both of them are inclined to each other in a little degree and toward the internal of the housing. By means of such a configuration, the spring of the closed end will increase and thus a snap effect will act when overload happens.

By means of the above structure, when the bimetallic blade 214 is in a normal position, the floating rocker 223 will alternatively force the conducting leaf 215 into a conduction/broken position in response to the inward/outward moving of the pressing stem 221, the push/pull of the pull-push rod 222, and the lock/unlock of the cantilever 224.

Figure 7:
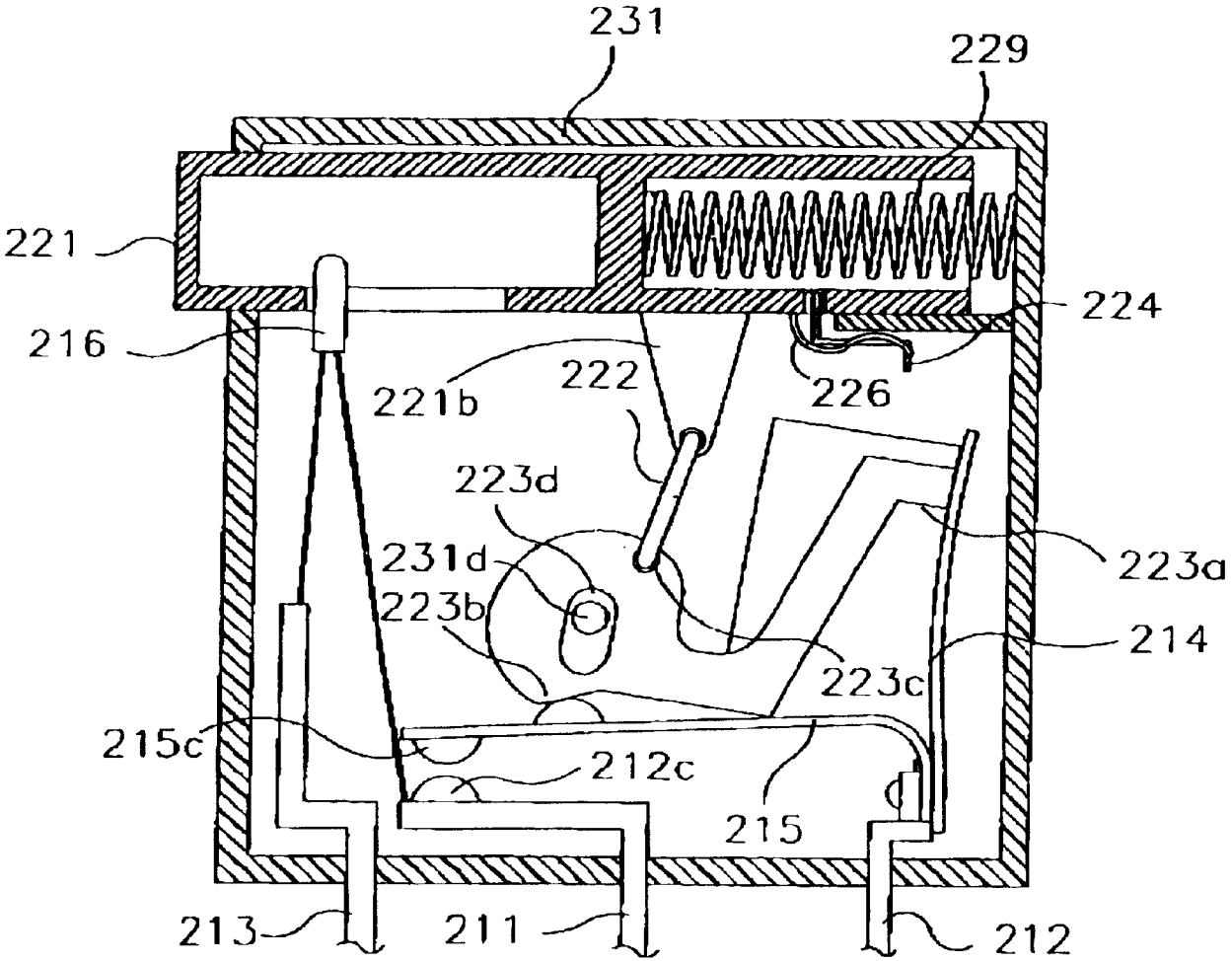
FIG. 7 is a view similar to FIG. 6 but in a trip status before the pressing stem returns to its reset position.

When the bimetallic blade 214 is in an overload position, the nose 223*b* and the toe portion 223*a* will upward and downward move respectively around the pull-push rod 222. As a result, the heart-shaped stepping recess 225 departs from the leg end of the cantilever 224 and the conducting leaf 215 departs from the first terminal 211, as shown in FIG. 7. Subsequently, along with the return of the pressing stem 221 to its reset position, the toe portion 223*a* will return to a position to be supported due to the pulling action of the pull-push rod 222 and the limitation of the shaft guider 231*d*. In such a position, the toe portion 223*a* could be supported again when the bimetallic blade returns to its normal position.

Figure 8:
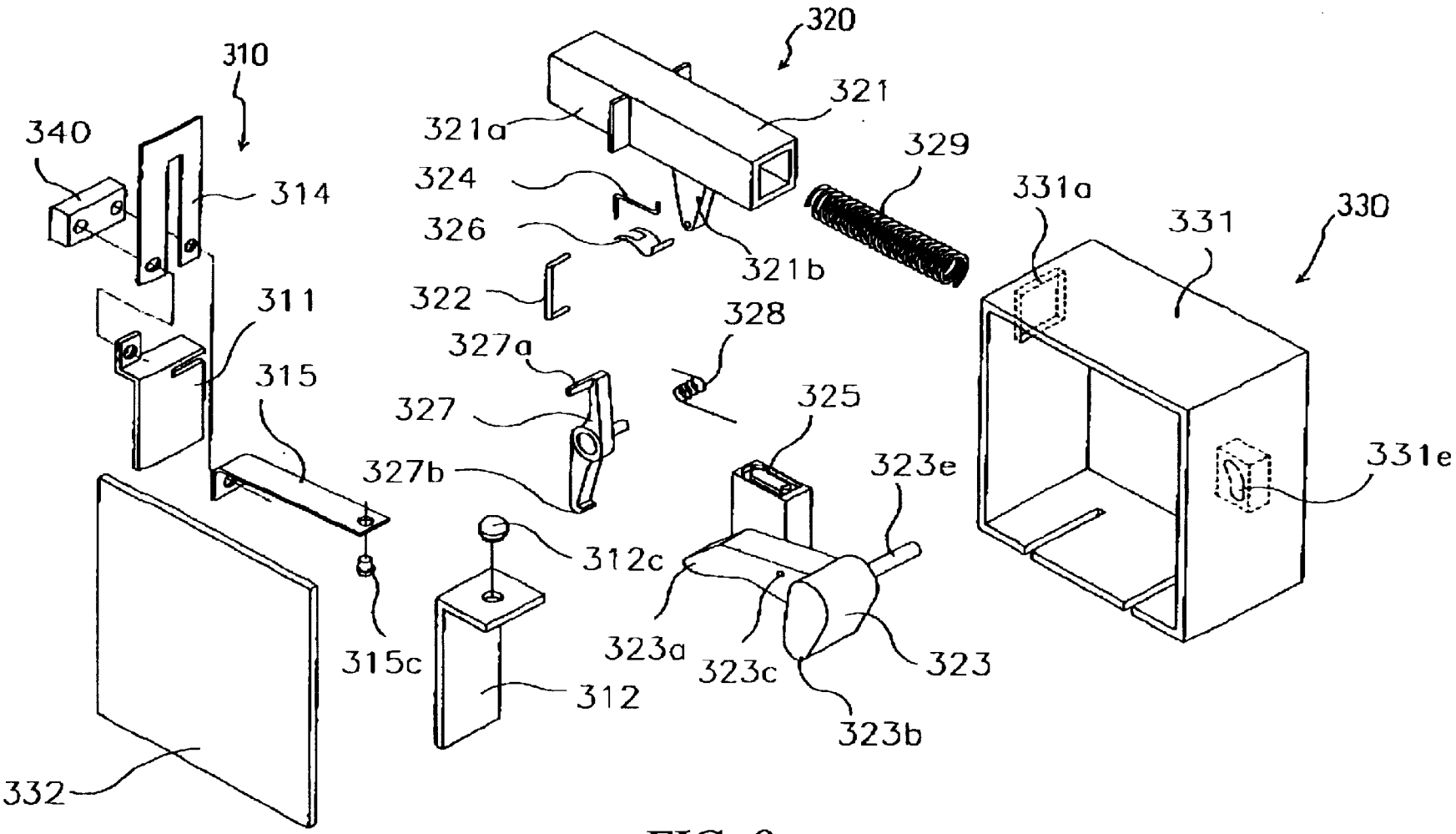
FIG. 8 is an exploded schematic perspective view of an overload-protection push-button switch with automatic reset mechanism of pull-push type in accordance with a third embodiment of this invention.

FIG. 8 shows an overload-protection push-button switch with an automatic resetting mechanism of pull-push type in accordance with a third embodiment of this invention. The switch generally comprises a switching circuit 310, an actuating unit 320 and a housing 330.

In comparison with the second embodiment, the pressing stem 321 is also provided with a seat 321*b*. However, the switching circuit 310 is provided with only a first terminal 311 and a second terminal 312. The bimetallic blade 314 also stands up but allocates at left side of the switch. As the actuating unit 320, a transmittal lever 327 and a lever-biasing spring 328 like the first embodiment has are also included. However, the shape of the floating rocker 323 is what shown in figures. The guided member 323*e* in the floating rocker of this embodiment is of a shape of shaft axially extending. The guider 331*e* in this embodiment is of a form of bended-slot formed in the main housing 331.

Figure 9:
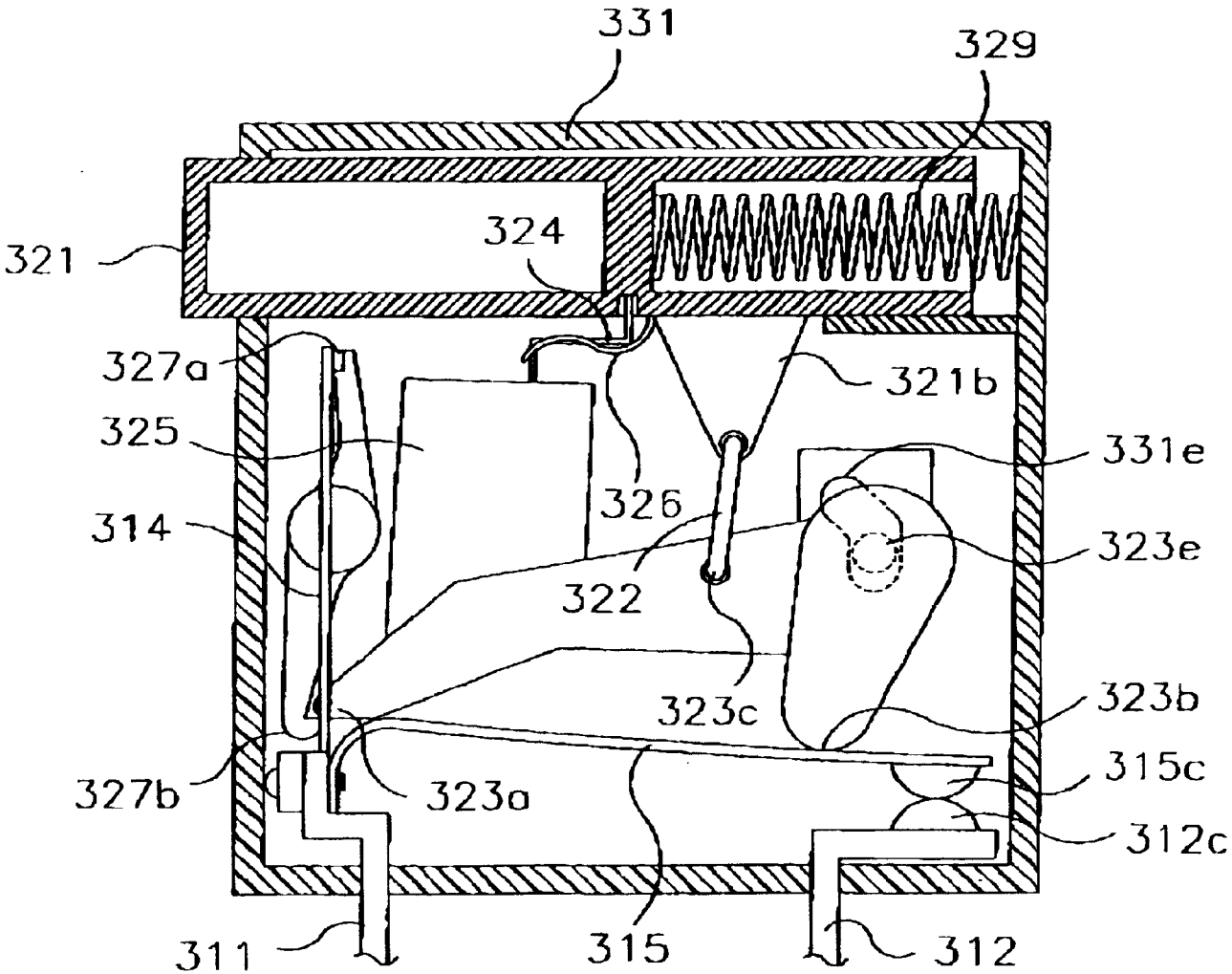
FIG. 9 is an assembled elevation view partly in section of the push-button switch of FIG. 8 in an ON status.

As shown in FIG. 9, the pressing stem 321, pull-push rod 322 and the rod-engaging rod 323*c* are substantially the same with those in the first embodiment. However, the toe portion 323*a* of the floating rocker 323 is supported by a supporting portion 327*b* of the transmittal lever 327, The transmittal lever 327 has an abutting surface 327*a* to be actuated by the closed end of the bimetallic blade 314. Moreover, the transmittal lever 327 is pivoted on the main shell 331 and has a lower hook-shaped supporting portion 327*b*. The heart-shaped stepping recess 325 is formed in a block and at a level which the leg end of the cantilever 324 can reach.

Figure 10:
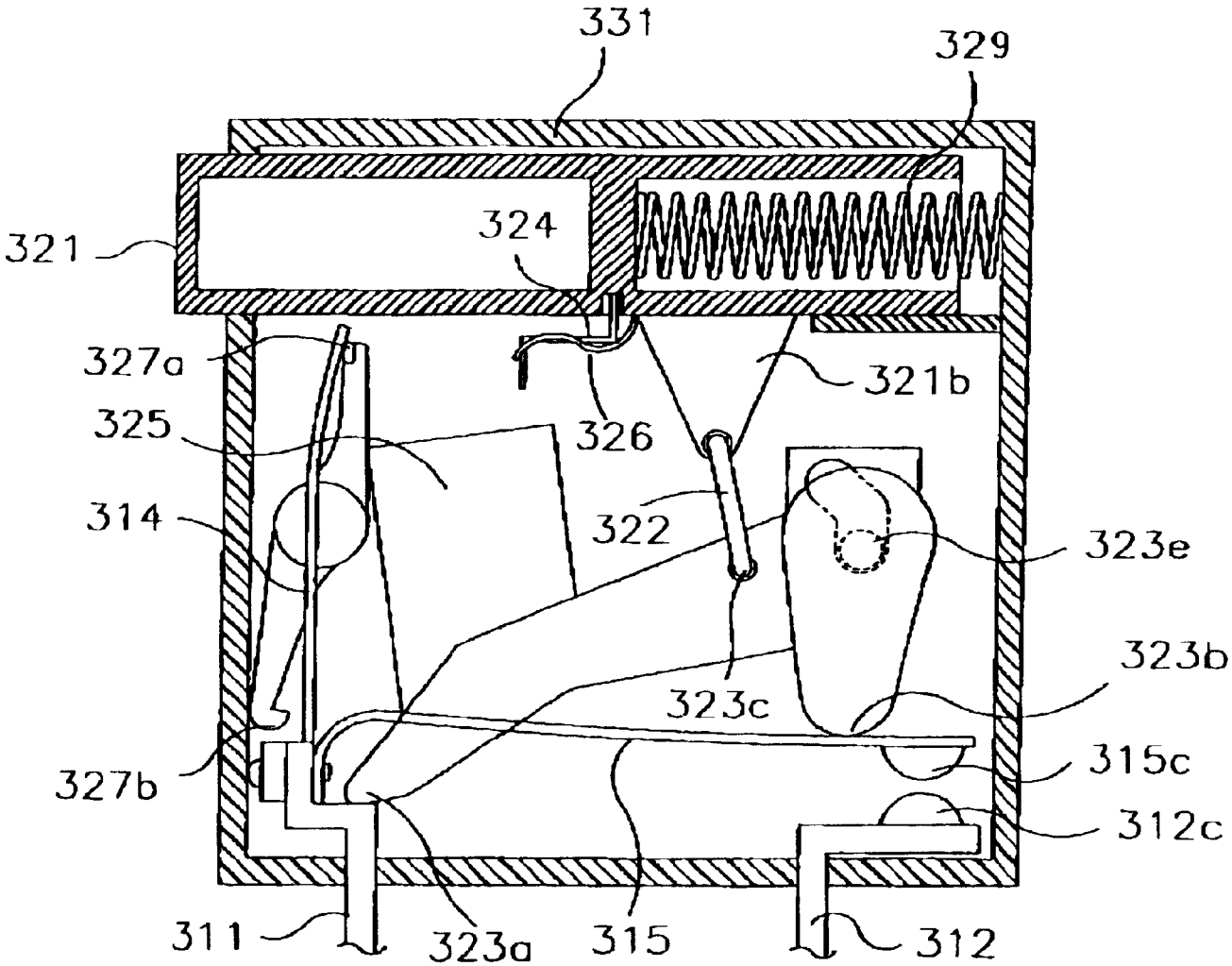
FIG. 10 is a view similar to FIG. 9 but in a trip status before the pressing stem returns to its reset position.

According to the design in the third embodiment, the function of automatically resetting and exactly tripping is also available. FIG. 10 shows a status in which trip is just happened due to overload while automatic reset is not completed. Since its operation is the same with that in the aforesaid first and second embodiment, its detailed description is also omitted herein.

Figure 11:
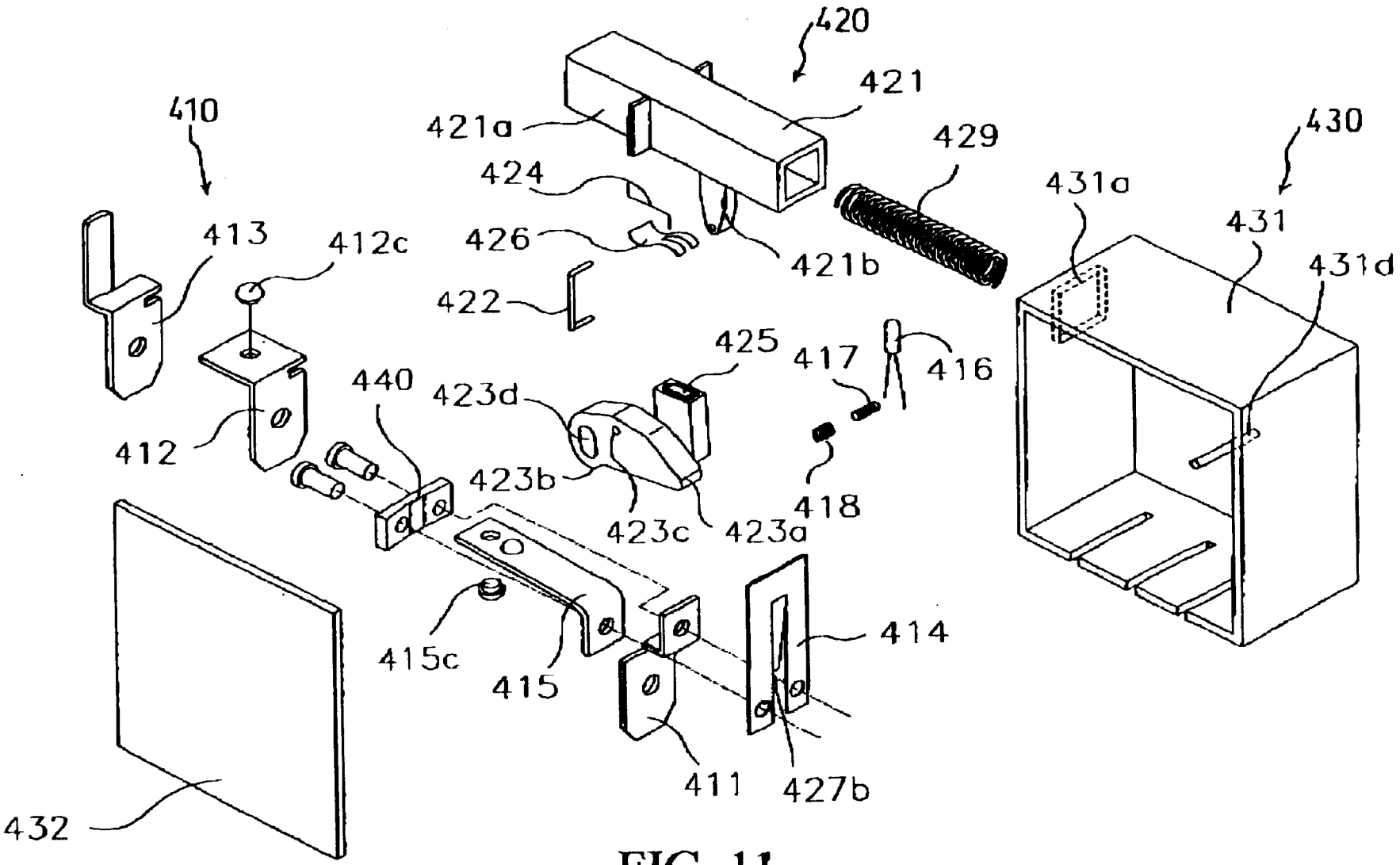
FIG. 11 is an exploded schematic perspective view of an overload-protection push-button switch with automatic reset mechanism of pull-push type in accordance with a fourth embodiment of this invention.
Figure 12:
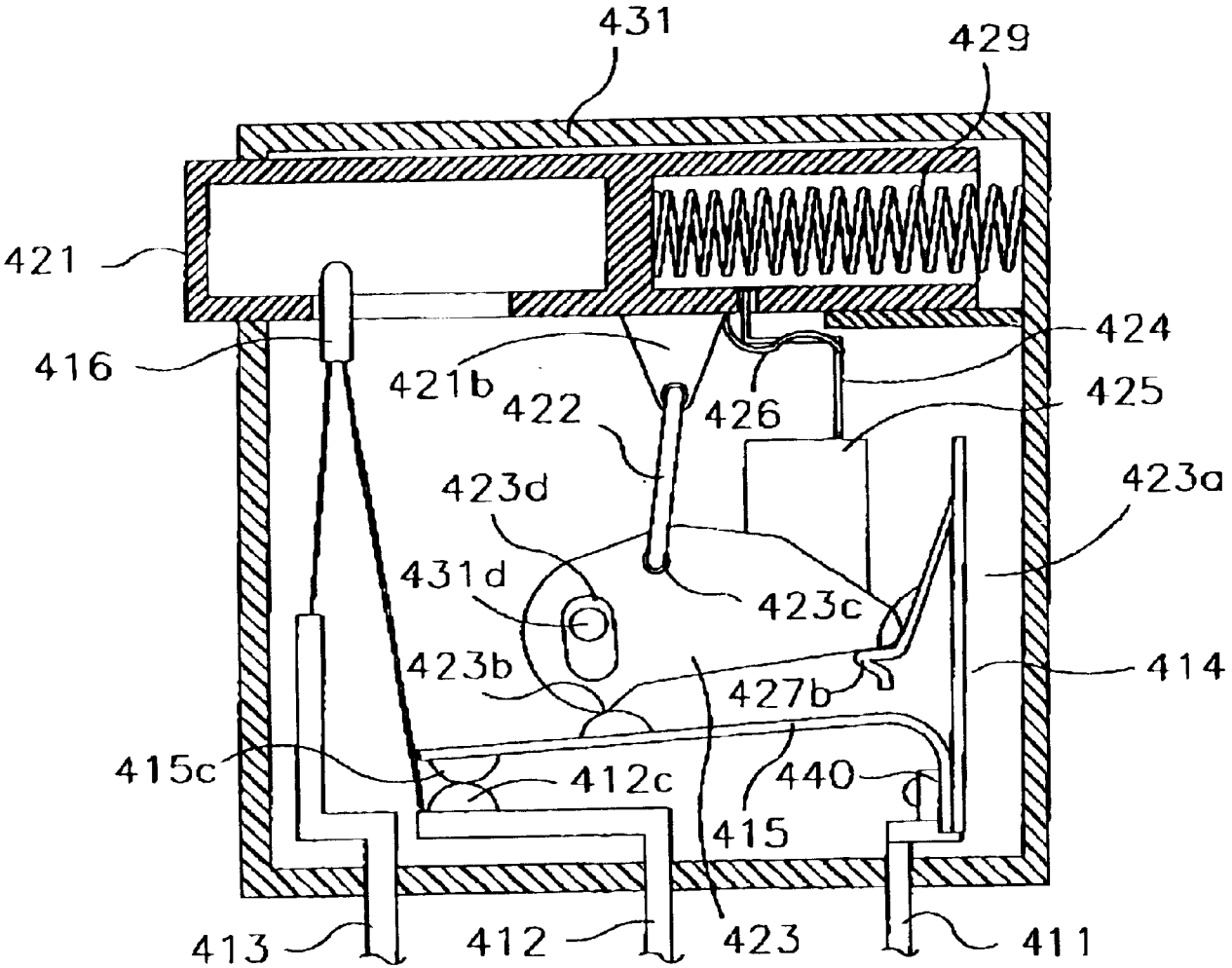
FIG. 12 is an assembled elevation view partly in section of the push-button switch of FIG. 11 in an ON status.
Figure 13:
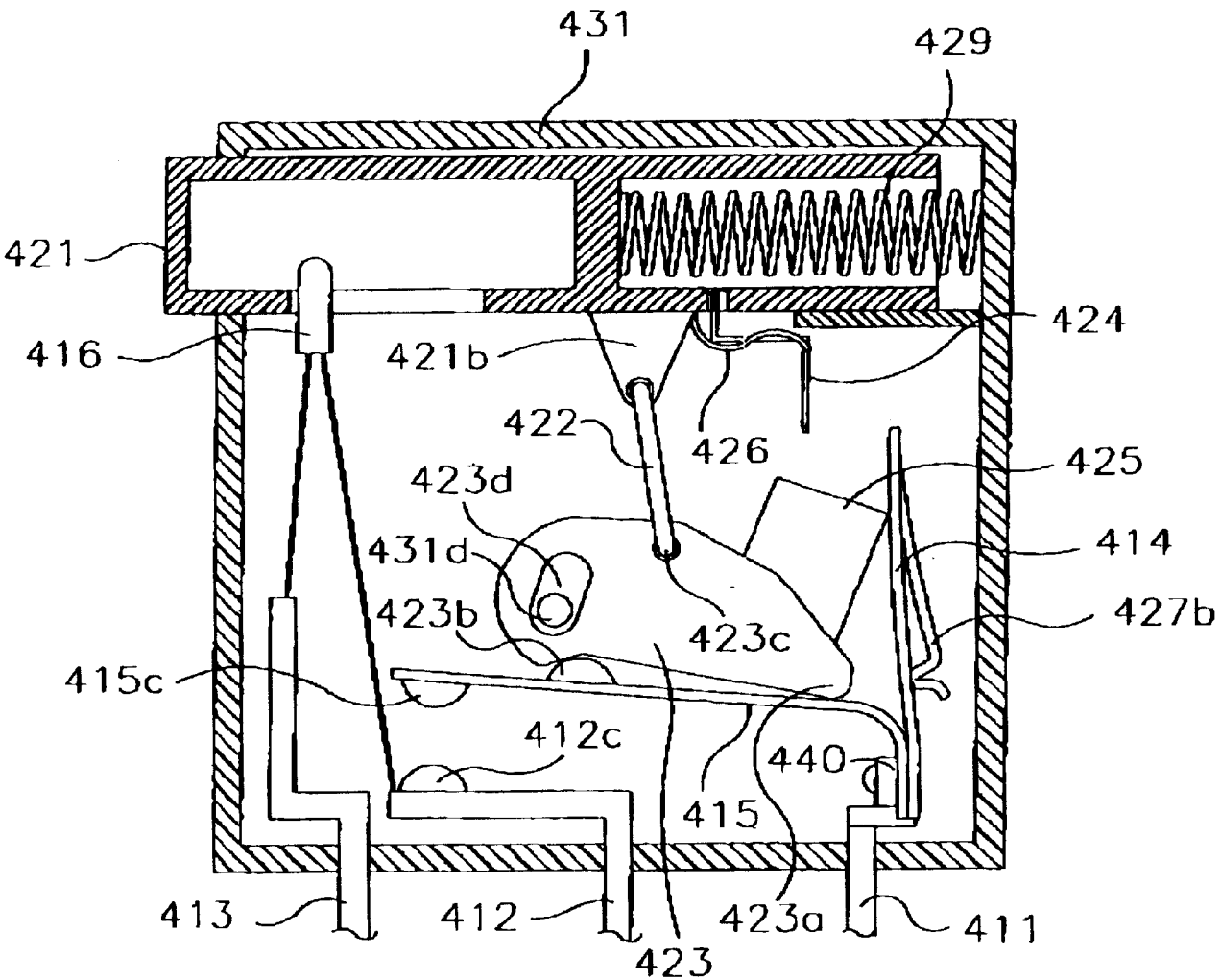
FIG. 13 is a view similar to FIG. 12 but in a trip status before the pressing stem returns to its reset position.

FIG. 11 shows an overload-protection push-button switch with an automatic resetting mechanism of pull-push type in accordance with a fourth embodiment of is invention. The switch shown in FIG. 11 is similar to the second embodiment, and generally comprises, as shown in FIGS. 12 and 13, a switching circuit 410, an actuating Unit 420 and a housing 430. The housing 430 comprises a main shell 431 and a cover 432. The switching circuit 410 comprises a first terminal 411, a second terminal 412, a third terminal 413, a thermal-deformed bimetallic blade 414, a first conducting leaf 415, an indicating lamp 416, a resistor 417 and a coil spring 418. The actuating unit 420 comprises a pressing stem 421, a pull-push rod 422, a floating rocker 423, a positioning unit mainly composed of a cantilever 424 and a heart-shaped stepping recess 425, a cantilever-biasing spring 426 and a stem-biasing spring 429. The toe portion 423*a* in this embodiment is also directly supported by the bimetallic blade 414. However, it is supported by a supporting portion 427*b* formed by bending an extension from the middle portion of the closed end of the bimetallic blade 414 to approximately the opening end thereof. Moreover, an insulating block 440 is also provided to fix the opening end of the bimetallic blade 414 so that the two legs of the opening end are angled. Thus, the extension and the supporting portion 427*b* will snap to depart from the toe portion 423*a* in case of overload. Furthermore, the heart-shaped stepping recess 425 is also formed in an extension integrally formed with the floating rocker 423 and at a lever capable of catching the free end of the cantilever 424 when the floating rocked 423 is mounted.

FIGS. 12 and 13 respectively show the elements of the switch in an ON status and in a transitional status after tripping but before completing reset. Since its motion is substantially the same with that in the second embodiment and thus its description is also omitted herein.

In comparison with any prior art, any one configuration in the embodiments of this invention can make sure of tripping and automatic reset in case of overload, allow the installation of an indicating lamp, and permit a lateral push on the button so as to meet some special requests.

While the present invention is described by way of preferred embodiments, it is understood that the embodiments are used only to illustrate the technical concept of the present invention without limiting the scope thereof. It is therefore intended to show that all modifications and alterations that are readily apparent to those skilled in the art are within the scope as defined in the appended claims.

What is claimed is:

1. An overload-protection push-button switch with an automatic resetting mechanism, comprising:

a housing;

a switching circuit installed in the housing, the switching circuit including:

a first terminal, a second terminal, a conducting leaf, and a bimetallic blade, having a movable closed end which is able to move from a normal position to an overload position, and an open end formed with a first and a second legs which connect the first terminal and the first conducting leaf, respectively; the conducting leaf being movable between a conduction position at which the second leg of the bimetallic blade is electrically connected to the second terminal and a broken position at which the second leg is disconnected from the second terminal; and an actuating unit installed in the housing, the actuating unit including:

a pressing stem received in the housing adapted to slide between a set and a reset positions;

a pull-push rod having two ends;

an enabling supporter being alternatively located in a supporting position and a tripping position in response to an allocation of the bimetallic blade in its normal position and its overload position, respectively;

a floating rocker being formed with a nose for abutting against the conducting leaf, a toe portion to be supported by the enabling supporter, a rod-engaging hole located between the nose and the toe portion to receive one end of the pull-push rod, a guided member for guiding a floating range produced by the rocker which is restricted by the pull-push rod, and a heart-shaped stepping recess located where the toe portion is;

a guider provided on the housing to abut the guided member so as to limit the floating range of the rocker;

a cantilever having a fixed end fixed onto the pressing stem and a free end adapted to slide in the heart-shaped stepping recess;

whereby the toe portion of the rocker is enabled and disabled in response to the allocation of the enabling supporter in a supporting and a tripping position, respectively in which when the toe portion is enabled, the nose presses and releases the conducting leaf to its conduction position and its broken position respectively in response to the allocation of the pressing stem in its set position and its reset position respectively under being driven by the pull-push rod and being limited by the guider; and when the toe portion is disabled, the nose releases the conducting leaf to its broken position; and the heart-shaped stepping recess departs from the free end of the cantilever when the toe portion is disabled so as to release the pressing stem to return to its reset position; and subsequently the toe portion of the rocker is pulled to a standby position so as to be supported and enabled by the enabling supporter again when the bimetallic blade returns to its normal position.

2. The switch according to claim 1, wherein the rod-engaging hole is formed in an arc shape, and the other end of the pull-push rod is fixed onto the pressing stem.

3. The switch according to claim 1, wherein the two ends of the pull-push rod is freely mounted on the pressing stem and the rod-engaging hole of the floating rocker.

4. The switch according to claim 1, wherein the guider is a slot the guided member is a cross bar.

5. The switch according to claim 1, wherein the guider is a cross bar and the guided member is formed as a slot.

6. The switch according to claim 1, wherein the closed end of the bimetallic blade has an edge and the enabling supporter is constructed by the edge.

7. The switch according to claim 1, wherein the enabling supporter is a lever pivotally mounted in the housing and having an abutting surface at one end thereof to be actuated by the bimetallic blade and a supporting portion at the other end to support the toe portion.

8. The switch according to claim 1, wherein the switching circuit further comprises a third terminal, and an indicating lamp serially connected between the third terminal and the second terminal; and wherein the pressing stem is provided with a space for receiving the indicating lamp.

* * * * *